US010617182B1

(12) United States Patent
Perkins

(10) Patent No.: US 10,617,182 B1
(45) Date of Patent: Apr. 14, 2020

(54) CANE AND PROXIMITY ALERT BRACELET ASSEMBLY

(71) Applicant: Joyce Perkins, Tulsa, OK (US)

(72) Inventor: Joyce Perkins, Tulsa, OK (US)

( * ) Notice: Subject to any disclaimer, the term of this patent is extended or adjusted under 35 U.S.C. 154(b) by 0 days.

(21) Appl. No.: 16/220,495

(22) Filed: Dec. 14, 2018

(51) Int. Cl.
*A45B 3/08* (2006.01)
*A61H 3/00* (2006.01)

(52) U.S. Cl.
CPC ..... *A45B 3/08* (2013.01); *A61H 3/00* (2013.01); *A61H 2201/165* (2013.01); *A61H 2201/5064* (2013.01)

(58) Field of Classification Search
CPC . A45B 3/08; F16M 13/08; A61H 3/00; A61H 2003/0205; A61H 2003/0272
See application file for complete search history.

(56) References Cited

U.S. PATENT DOCUMENTS

| | | | | |
|---|---|---|---|---|
| 5,097,856 | A | 3/1992 | Chi-Sheng | |
| 5,351,004 | A | 9/1994 | Daniels | |
| 6,853,909 | B2 | 2/2005 | Scherzinger | |
| 6,867,697 | B2 | 3/2005 | Nanayakkara | |
| 8,812,231 | B1 | 8/2014 | Brickous | |
| 9,183,708 | B2 | 11/2015 | Daeef | |
| 2009/0223546 | A1* | 9/2009 | Nazarian | A45B 3/04 135/66 |

* cited by examiner

*Primary Examiner* — Curtis B Odom

(57) ABSTRACT

A cane and proximity alert bracelet assembly for prevent losing a cane includes a base, a shaft coupled to the base, and a handle coupled to the shaft. A transmitter is coupled within the handle. A cane alert is coupled to the handle and is in operational communication with the transmitter. A proximity alert bracelet comprises a bracelet body configured to be worn by a user. A receiver is coupled within the bracelet body and is in operational communication with the transmitter of the cane. A bracelet alert is coupled to the bracelet body and is in operational communication with the receiver. Each of the cane alert and the bracelet alert is activated when the receiver and the transmitter reach a predetermined distance apart to alert the user.

7 Claims, 4 Drawing Sheets

CANE AND PROXIMITY ALERT BRACELET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to canes and more particularly pertains to a new cane for prevent losing a cane.

BRIEF SUMMARY OF THE INVENTION

An embodiment of the disclosure meets the needs presented above by generally comprising a base, a shaft coupled to the base, and a handle coupled to the shaft. The handle is selectively engageable with the shaft. A transmitter is coupled within the handle. A cane alert is coupled to the handle and is in operational communication with the transmitter. A cane power source is coupled within the shaft and is in operational communication with each of the transmitter and the cane alert. A proximity alert bracelet comprises a bracelet body. The bracelet body is configured to be worn by a user. A receiver is coupled within the bracelet body and is in operational communication with the transmitter of the cane. A bracelet alert is coupled to the bracelet body and is in operational communication with the receiver. A bracelet power source is coupled within the bracelet body and is in operational communication with each of the receiver and the bracelet alert. Each of the cane alert and the bracelet alert is activated when the receiver and the transmitter reach a predetermined distance apart to alert the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
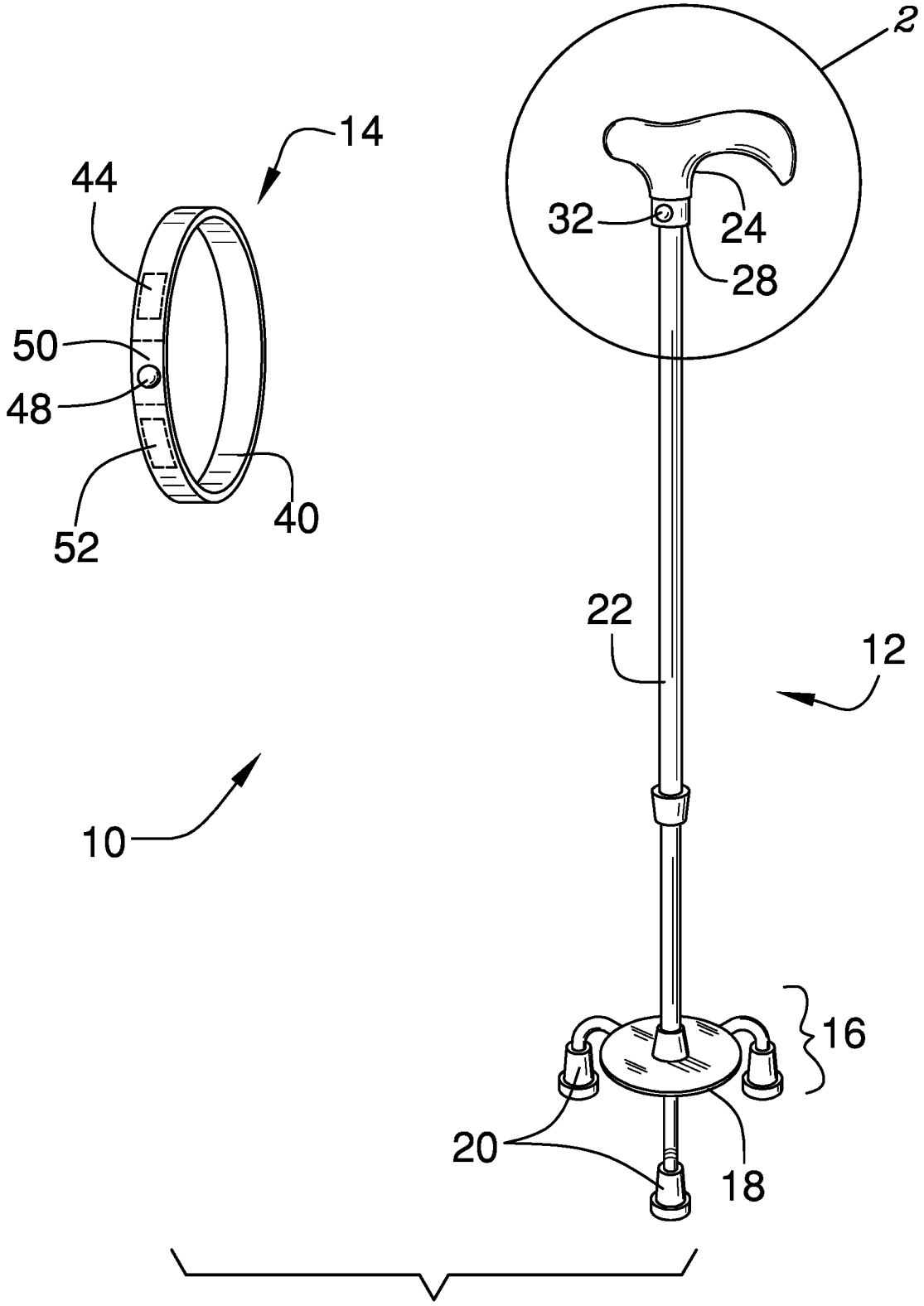
FIG. 1 is an isometric view of a cane and proximity alert bracelet assembly according to an embodiment of the disclosure.
Figure 2:
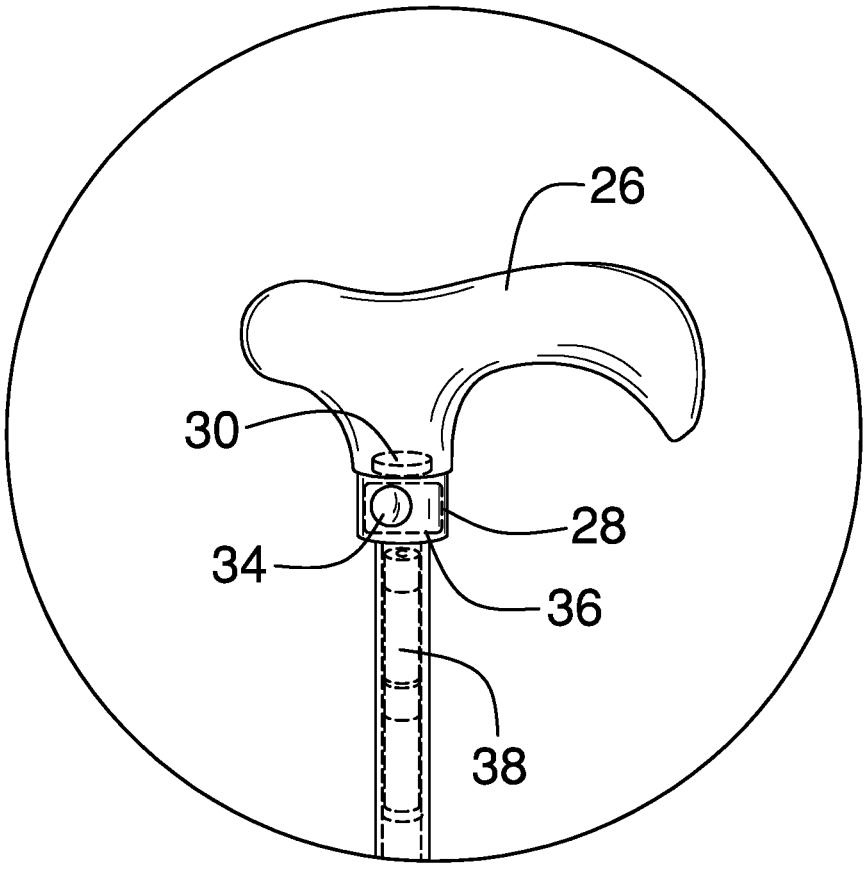
FIG. 2 is a detail view of an embodiment of the disclosure.
Figure 3:
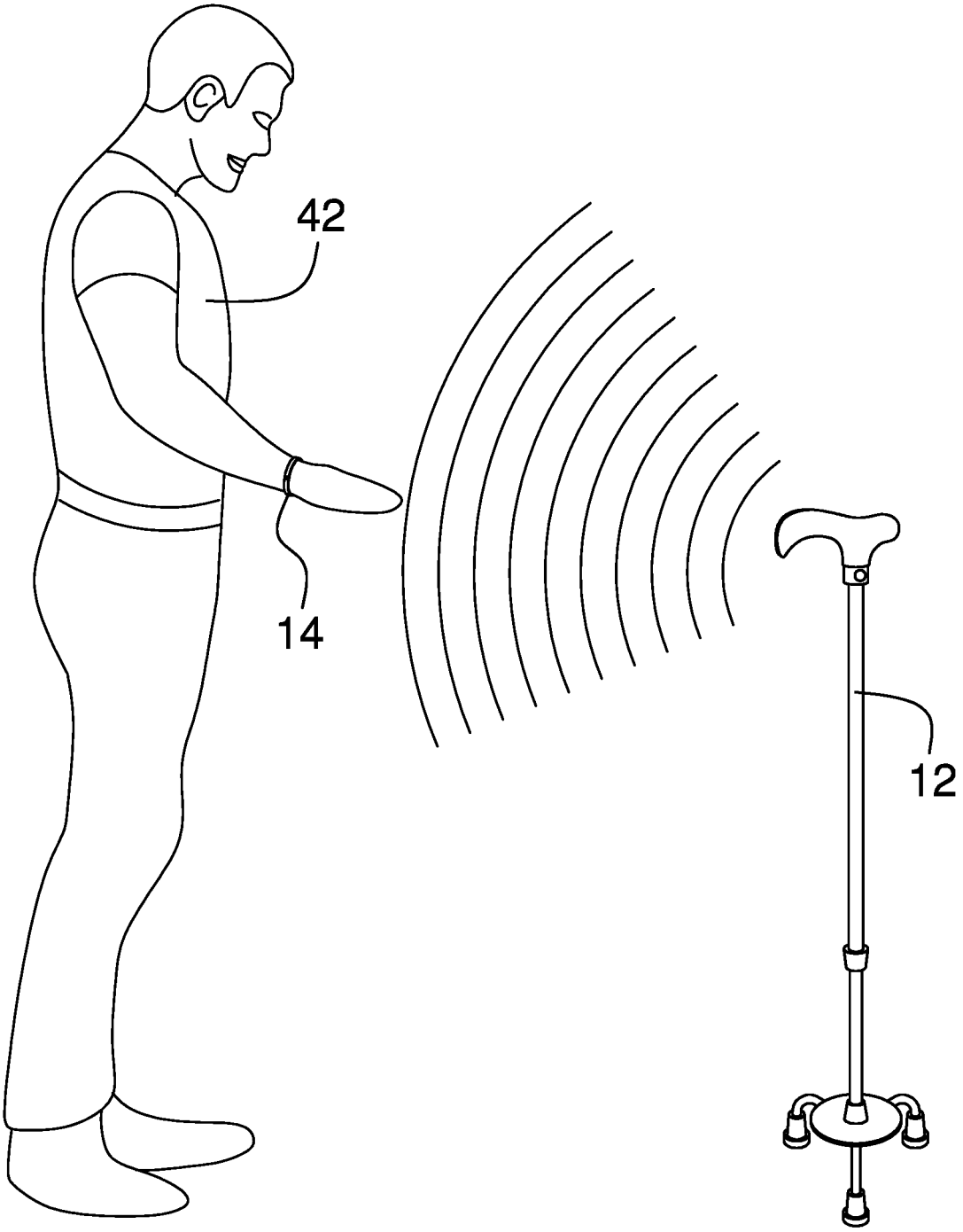
FIG. 3 is an in-use view of an embodiment of the disclosure.
Figure 4:
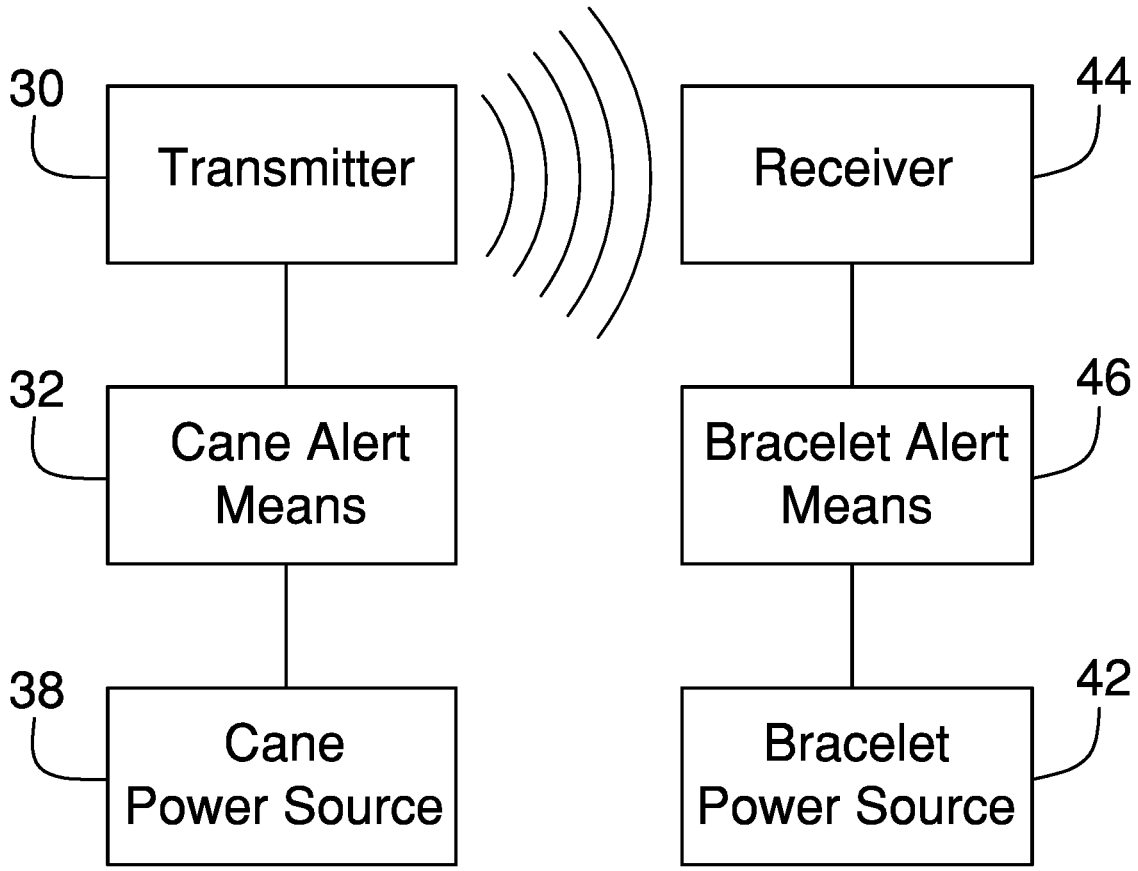
FIG. 4 is a block diagram of an embodiment of the disclosure.

With reference now to the drawings, and in particular to FIGS. 1 through 4 thereof, a new cane embodying the principles and concepts of an embodiment of the disclosure and generally designated by the reference numeral 10 will be described.

As best illustrated in FIGS. 1 through 4, the cane and proximity alert bracelet assembly 10 generally comprises a cane 12 and a proximity alert bracelet 14. The cane 12 comprises a base 16 comprising a base platform 18 and a plurality of legs 20. The plurality of legs 20 is coupled to the base platform 18. A shaft 22 is coupled to the base platform 18. The shaft 22 may be telescopable. A handle 24 is coupled to the shaft 22. The handle 24 may have an ergonomic grip 26 and a collar 28. The collar 28 is selectively engageable with the shaft 22 and the ergonomic grip 26 is coupled to the collar 28. A transmitter 30 is coupled within the handle 24. A cane alert 32 is coupled to the handle 24 and is in operational communication with the transmitter 30. The cane alert 32 may comprise a first light 34 and a first vibration mechanism 36. Each of the first light 34 and the first vibration mechanism 36 is coupled to the collar 28. A cane power source 38 is coupled within the shaft 22 and is in operational communication with each of the transmitter 30 and the cane alert 32.

The proximity alert bracelet 14 comprises a bracelet body 40 that is configured to be worn by a user 42. A receiver 44 is coupled within the bracelet body 40 and is in operational communication with the transmitter 30 of the cane. A bracelet alert 46 is coupled to the bracelet body 40 and is in operational communication with the receiver 44. The bracelet alert 46 comprises a second light 48 and a second vibration mechanism 50. A bracelet power source 52 is coupled within the bracelet body and in operational communication with each of the receiver 44 and the bracelet alert 46.

In use, each of the cane alert 32 and the bracelet alert 46 is activated when the receiver 44 and the transmitter 30 reach a predetermined distance apart, each of the first light 34 and the second light 48 producing a visual alarm to alert the user 42, each of the first vibration mechanism 36 and the second vibration mechanism 50 producing a haptic alarm to alert the user 42 to prevent her from leaving the cane 12 in another room.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cane and proximity alert bracelet assembly comprising:

a cane, the cane comprising:

a base;

a shaft coupled to the base;

a handle coupled to the shaft, the handle being selectively engageable with the shaft;

a transmitter coupled within the handle;

a cane alert coupled to the handle, the cane alert being in operational communication with the transmitter; and a cane power source coupled within the shaft, the cane power source being in operational communication with each of the transmitter and the cane alert; and a proximity alert bracelet, the proximity alert bracelet comprising:

a bracelet body, the bracelet body being configured to be worn by a user;

a receiver coupled within the bracelet body, the receiver being in operational communication with the transmitter of the cane;

a bracelet alert coupled to the bracelet body, the bracelet alert being in operational communication with the receiver; and a bracelet power source coupled within the bracelet body, the bracelet power source being in operational communication with each of the receiver and the bracelet alert;

wherein each of the cane alert and the bracelet alert is activated when the receiver and the transmitter reach a predetermined distance apart to alert the user.

2. The cane and proximity alert bracelet assembly of claim 1 further comprising the cane alert comprising a first light and the bracelet alert comprising a second light, each of the first light and the second light producing a visual alarm to alert the user when the receiver and the transmitter reach the predetermined distance apart.

3. The cane and proximity alert bracelet assembly of claim 2 further comprising the bracelet alert comprising a first vibration mechanism and the bracelet alert comprising a second vibration mechanism, each of the first vibration mechanism and the second vibration mechanism producing a haptic alarm to alert the user when the receiver and the transmitter reach the predetermined distance apart.

4. The cane and proximity alert bracelet assembly of claim 1 further comprising the base comprising a base platform and a plurality of legs, the base platform being coupled to the shaft and the plurality of legs being coupled to the base platform.

5. The cane and proximity alert bracelet assembly of claim 4 further comprising the shaft being telescopable.

6. The cane and proximity alert bracelet assembly of claim 3 further comprising the handle having an ergonomic grip and a collar, the collar being selectively engageable with the shaft, the ergonomic grip being coupled to the collar, each of the first light and the first vibration mechanism being coupled to the collar.

7. A cane and proximity alert bracelet assembly comprising:

a cane, the cane comprising:

a base, the base comprising a base platform and a plurality of legs, the plurality of legs being coupled to the base platform;

a shaft coupled to the base, the shaft being coupled to the base platform, the shaft being telescopable;

a handle coupled to the shaft, the handle having an ergonomic grip and a collar, the collar being selectively engageable with the shaft, the ergonomic grip being coupled to the collar;

a transmitter coupled within the handle;

a cane alert coupled to the handle, the cane alert being in operational communication with the transmitter, the cane alert comprising a first light and a first vibration mechanism, each of the first light and the first vibration mechanism being coupled to the collar; and a cane power source coupled within the shaft, the cane power source being in operational communication with each of the transmitter and the cane alert; and a proximity alert bracelet, the proximity alert bracelet comprising:

a bracelet body, the bracelet body being configured to be worn by a user;

a receiver coupled within the bracelet body, the receiver being in operational communication with the transmitter of the cane;

a bracelet alert coupled to the bracelet body, the bracelet alert being in operational communication with the receiver, the bracelet alert comprising a second light and a second vibration mechanism; and a bracelet power source coupled within the bracelet body, the bracelet power source being in operational communication with each of the receiver and the bracelet alert;

wherein each of the cane alert and the bracelet alert is activated when the receiver and the transmitter reach a predetermined distance apart, each of the first light and the second light producing a visual alarm to alert the user, each of the first vibration mechanism and the second vibration mechanism producing a haptic alarm to alert the user.

* * * * *